US009739490B2

(12) United States Patent
Richter

(10) Patent No.: US 9,739,490 B2
(45) Date of Patent: Aug. 22, 2017

(54) RADIANT HEAT REFLECTOR WING

(71) Applicant: Roberts-Gordon LLC, Buffalo, NY (US)

(72) Inventor: Stephan Richter, Lake View, NY (US)

(73) Assignee: Roberts-Gordon LLC, Buffalo, NY (US)

( * ) Notice: Subject to any disclaimer, the term of this patent is extended or adjusted under 35 U.S.C. 154(b) by 140 days.

(21) Appl. No.: 14/821,219

(22) Filed: Aug. 7, 2015

(65) Prior Publication Data

US 2017/0038082 A1 Feb. 9, 2017

(51) Int. Cl.
*F24C 15/24* (2006.01)
*F24D 5/08* (2006.01)
*F24D 5/06* (2006.01)

(52) U.S. Cl.
CPC *F24D 5/08* (2013.01); *F24D 5/06* (2013.01)

(58) Field of Classification Search
CPC ..... F24D 15/24; F24C 1/10
USPC ..... 126/91 A, 92 R, 92 B; 431/328, 329
See application file for complete search history.

(56) References Cited

U.S. PATENT DOCUMENTS 3,310,102 A 3/1967 Trombe
3,591,767 A * 7/1971 Mudie ..... B65B 53/02 219/244
3,805,763 A * 4/1974 Cowan ..... F23D 14/14 126/92 B
4,319,125 A * 3/1982 Prince ..... F24C 1/10 126/92 B
4,727,854 A * 3/1988 Johnson ..... F24C 1/10 126/91 A
5,626,125 A 5/1997 Eaves
7,489,858 B2 2/2009 Zank
9,022,298 B2 * 5/2015 Catteau ..... F24C 15/22 126/91 A
2011/0049253 A1 3/2011 Catteau

OTHER PUBLICATIONS

CAN/ANSI/AHRI 1330-2015, Performance Rating for Radiant Output of Gas Fired Infrared Heaters, printed prior to to Mar. 2015.
CAN/ANSI/AHRI 1330-2014, Performance Rating for Radiant Output of Gas Fired Infrared Heaters, 2014.
https://www.reverberray.com/products/commercial-industrial-products-usa/, photos were available prior to Aug. 7, 2015.

* cited by examiner

*Primary Examiner* — Avinash Savani
(74) *Attorney, Agent, or Firm* — Roach Brown McCarthy & Gruber, P.C.; Kevin D. McCarthy

(57) ABSTRACT

A radiant heating apparatus having a tube, a partial enclosure device and a heating wing. The heating wing has a wing proximal end that connects to the partial enclosure device's exterior surface. The heating wing also has a wing distal end that obliquely extends outwardly in relation to the partial enclosure device and toward a first direction. The heating wing, except at the wing proximal end, and the partial enclosure device's exterior surface are spaced apart so the heating wing re-directs second direction heat energy in the first direction.

20 Claims, 22 Drawing Sheets

RADIANT HEAT REFLECTOR WING

FIELD OF THE INVENTION

This invention is directed to a radiant heater device to render a radiant heater more efficient.

BACKGROUND OF THE INVENTION

Trombe in U.S. Pat. No. 3,310,102 illustrates and describes conventional reflector designs used in radiant heaters. Those conventional reflector designs have a "flat top shape", "an involute of a cylindrical radiating shape", and "a cylindro-parabolic shape". These reflector shapes are fundamental and generic reflector shapes used in radiant heaters. All other reflector shapes are variations thereof. A common feature of these reflector shapes is that there is a top section positioned over and spaced from a top surface of a tube through which a hot fluid is transported and the tube radiates heat energy to transfer the heat energy to surrounding air; and two corresponding side surfaces that positioned along and spaced from both side surfaces of the tube or on side surface of the tube if the tube is "U" shaped and the reflector partially encloses the entire "U" configuration.

In U.S. patent application publication number 2011/0049253, Catteau et al. describe (a) the fundamental aspects of how conventional radiant heaters operate, (b) conventional radiant heater component parts, and (c) some variations of the above-identified reflector shapes. That description is as follows: "Radiant heaters are frequently used in warehouses, factories, and commercial settings to provide a warm environment during cold weather. In such systems, tubular conduits (e.g., "tubes") may hang from the ceiling or other overhead structure. A heated fluid (provided by a power plant) passes through the tube and heats the tube. The tube radiates heat waves (e.g., heat transfer by radiation) to an adjacent area, such as toward the floor or an object (a) positioned on the floor and (b) that may be permanent or transitory—like a person standing at or near, partaking in an activity at or near, or passing through or near the heated floor area. A reflector may direct the radiated heat in a desired direction. A heating system of this type may warm objects or people on loading docks, near open doorways, or where conditions may cause a high heat loss. . . .

FIG. 1A is a diagram of a radiant heater 100. Radiant heater 100 may hang from a ceiling, for example, for the purpose of radiating heat downward toward a floor. FIG. 1B is a cross-sectional drawing of radiant heater 100 of FIG. 1A. Radiant heater 100 includes an emitting tube 102, a reflector 104, and a space 106 separating emitting tube 102 and reflector 104. Radiant heater 100 may also include an insulation layer 114, shown only in FIG. 1B.

Emitting tube 102 carries a heated fluid (e.g., hot flue gas), which heats emitting tube 102 to high temperatures. As a result, emitting tube 102 radiates heat waves 110 (e.g., heat wave 110-1, 110-2, 110-3, and 110-4, shown in FIG. 1B as solid lines parallel to the direction of travel of the waves). As shown in FIG. 1B, heat wave 110-1 radiates directly toward a floor 108, where the heat is desired, for example. Heat waves 110-2, 110-3, and 110-4, on the other hand, radiate toward reflector 104.

Reflector 104 reflects heat waves 110-2, 110-3, and 110-4 toward floor 108 as reflected heat waves 112 (e.g., heat waves 112-1, 112-2, and 112-3 shown in FIG. 1B as dashed lines parallel to the direction of travel of the waves). Heat wave 112-3, however, is also reflected toward emitting tube 102 and emitting tube 102 may absorb portions of heat wave 112-3 and its energy. In this example, portions of heat wave 112-3 may not reach floor 108 and energy may be potentially lost.

Space 106 and reflector 104 may become hot themselves (e.g., the air in space 106 being in contact with emitting tube 102 (conduction), the convection in the air, and the contact of the air with reflector 104). To slow heat transfer in the upward direction (e.g., away from floor 108) and to reduce heat loss, an insulation layer 114 may reside above reflector 104.

FIG. 2A is a perspective drawing of an exemplary radiant heater 200 in one embodiment. Radiant heater 200, like radiant heater 100, may hang from a ceiling, for example, for the purpose of radiating heat downward toward a floor. FIG. 2B is a cross-sectional drawing of radiant heater 200. Radiant heater 200 includes an emitting tube 202, a reflector 204, and a space 206 separating emitting tube 202 and reflector 204.

Emitting tube 202 carries heated fluid (e.g., hot flue gas), which may heat emitting tube 202 to high temperatures. As a result, emitting tube 202 radiates heat waves 210 (shown in FIG. 2B as solid lines parallel to the direction of travel of the wave). Although emitting tube 102 radiates heat waves in all directions, only heat waves radiated toward the left portion of reflector 204 are shown in FIG. 2B for simplicity.

Reflector 204 reflects heat waves 210 toward a floor 208 as reflected heat waves 212 (shown in FIG. 2B as dashed lines parallel to the direction of travel of the waves). Unlike reflector 104, however, reflector 204 is shaped to reflect heat waves 210 substantially around emitting tube 202. This embodiment may allow for fewer heat waves being reflected back to and be absorbed by emitting tube 202. Instead, this embodiment may allow for more heat waves (e.g., more energy) to be reflected toward floor 208, where the heat is desired. In one embodiment, substantially all the radiation that impinges on reflector 204 is reflected around emitting tube 202. A more detailed description of embodiments of the shape of reflector 204 is discussed below with respect to FIGS. 7A through 7F and 8A through 8D.

As shown in FIG. 2B, reflector 204 may include a first curved surface 204-1 and a second curved surface 204-2 that meet at a junction 220. Emitting tube 202 may be considered a line source P (also referred to as "center axis P" or "point source P") emitting radiation 210. The properties and shape of first surface 204-1 allows emitted radiation 210 to be reflected (e.g., radiation 212) around emitting tube 202, with a clearance distance D. As shown in FIG. 2B, the dimensions of emitting tube 202 may be sized to have a radius greater than R. For example, emitting tube 202 may have a radius of R+D before reflected radiation 212 would impinge on emitting tube 202. The area/volume from line source P to R+D may be known as a reflection-free envelope, inside of which may be substantially free of reflected radiation.

Although emitting tube 202 may be sized larger, in one embodiment emitting tube 202 is kept a distance from the reflection envelope and junction 220. For example, the distance from emitting tube 202 to junction 220 may be between 35 to 40 millimeters (mm), 30 to 35 mm, 25 to 30 mm, 20 to 25 mm, 15 to 20 mm, 10 to 15 mm, 5 to 10 mm, or less than 5 mm. In one embodiment, the distance from emitting tube 202 to junction 220 is 29.29 mm, where the radius of emitting tube 202 is 38.05 mm and the distance between center axis P is 67.34 mm. In another embodiment, the distance from emitting tube 202 to junction 220 is 16.54 mm, where the radius of emitting tube 202 is 50.8 mm and the distance between center axis P is 67.34. The dimensions of emitting tube 202 may also be scaled smaller such that its radius may be smaller than radius R shown in FIG. 2B.

Viewed in another way, the dimensions of reflector 204 may be correspondingly scaled down before reflected radiation 212 would impinge on emitting tube 202. Alternatively, the dimensions of reflector 204 may be increased and reflected radiation 212 may still avoid emitting tube 202. Thus, reflector 204 may be designed to accommodate many different sizes of emitting tubes.

FIG. 3A is a perspective drawing of reflector 204. Reflector 204 may be formed of a metal, such as stainless steel. In one embodiment, reflector 204 is formed of one sheet of metal that is continuous from a first lip 304-1 to a second lip 304-2 (lips 304) of reflector 204. Lips 304 may provide strength to support the weight of reflector 204 when installed and may provide rigidity along the length of reflector 204 (e.g., parallel with emitting tube 202). In this embodiment, reflector 204 may be rolled, drawn, or pressed into the shape shown. In one embodiment, reflector 204 may be constructed of aluminized steel.

In another embodiment, reflector 204 may be formed of multiple (e.g., two) sheets of metal. FIG. 3B is a disassembled, cross-sectional drawing of reflector 204 formed from two sheets of metal. In FIG. 3B, reflector 204 comprises a first sheet 302-1 and a second sheet 302-2. Reflector 204 may include more or fewer portions than shown. First and second sheets 302-1 and 302-2 may be rolled, drawn, or pressed into the shapes shown. Sheets 302-1 and 302-2 may allow for a compact, disassembled reflector 204 for easier transportation of radiant heater 200.

First sheet 302-1 may include first lip 304-1 and a first flange 306-1 that may run along junction 220. Flange 306-1 may provide rigidity along the length of sheet 302-1 and may overlap with a portion of second sheet 302-2 to allow first and second sheets 302-1 and 302-2 to be joined together by, for example, bolts along the length of such an overlap. Second sheet 302-2 may include second lip 304-2 and a second flange 306-2. Flange 306-2 may also overlap with a portion of first sheet 302-1 to allow first and second sheets 302-1 and 302-2 to be joined together by, for example, bolts along the length of such an overlap.

In one embodiment, a joining strip 310 may overlap with first sheet 302-1 and second sheet 302-2 along their lengths. Joining strip 310 may allow first and second sheets 302-1 and 302-2 to be joined together by, for example, bolts along the length of the overlap between joining strip 310 and first sheet 302-1 and bolts along the length of the overlap between joining strip 310 and second sheet 302-2. In an embodiment with joining strip 310, for example, flanges 306-1 and 306-2 may be omitted.

In one embodiment, joining strip 310 is short compared to the length of reflector 204. In this embodiment, multiple joining strips may be used along the length of reflector 204. For example, a joining strip 310 may be used at each end of reflector 204 and a joining strip 310 may be used in the middle of reflector 204. . . .

FIG. 4A is a cross-sectional drawing of one embodiment of an exemplary radiant heater 400 with a heat converter hood 402. As described below, converter hood 402 converts and directs heat energy. Radiant heater 400, like radiant heater 200, includes emitting tube 202 and reflector 204. Converter hood 402 is placed above reflector 204 to form a space 404 between reflector 204 and converter hood 402. FIG. 4B is a perspective drawing of radiant heater 400 showing an exemplary positioning of converter hood 402 with respect to reflector 204. The distance from junction 220 of reflector to converter hood 402 may range, for example, from 40 to 35 mm, 35 to 30 mm, 30 to 25 mm, 25 to 20 mm, 20 to 15 mm, 15 to 10 mm, 10 to 5 mm, or less than 5 mm. In one embodiment, the distance from junction 220 of reflector 204 to converter hood 402 is approximately 24 mm.

Emitting tube 202 becomes hot as a result of hot gasses passing through emitting tube 202. In addition to emitting thermal radiation, emitting tube 202 heats the air in space 206 surrounding emitting tube 202 (e.g., through contact of the air with emitting tube 202, or conduction). Heat may also transfer through the air in space 206 as well as the air in space 404 between reflector 204 and converter hood 402 (e.g., through convection). Reflector 204 may also conduct heat from space 206 to space 404. Hot air in space 404 is depicted in FIG. 4A as amorphous shapes.

Heat may build up in space 404 between reflector 204 and converter hood 402, and particularly at the surface of converter hood 402 by the convection of the air in space 404. As a result, converter hood 402 may capture this heat energy (e.g., become hot itself) and may begin to radiate energy. In other words, converter hood 402 may convert the heat energy transferred through convection to the surface of converter hood 402 into heat energy radiated through space. As shown in FIG. 4A, converter hood 402 radiates heat waves 406 (also referred to as radiation 406, depicted as solid lines in the direction of the travel of the wave). Radiation 406 is in addition to reflected radiation 212 and emitted radiation 210.

Converter hood 402 may include corrugated portions to capture heat more effectively and to help distribute the heat energy throughout space 404. Capturing and converting heat energy around emitting tube 202, by converter hood 402, allows emitting tube 202 to operate at lower temperatures. Operating emitting tube 202 at lower temperatures may extend the life of emitting tube 202, or may allow more hot fluid to pass through emitting tube 202 without reaching its maximum rated temperatures.

FIG. 5A is a perspective drawing of converter hood 402. FIG. 5B is a cross-sectional drawing of converter hood 402. Converter hood 402 may include angled or corrugated portions 508 along the sides and a flat portion 510 along the middle of converter hood 402. Converter hood 402 may be formed from a single piece of sheet metal from one end (e.g., a first flange 506-1) to the other end (e.g., a second flange 506-2). Converter hood 402 may be rolled, drawn, or pressed into the shape.

Corrugated portions 508 may increase the surface area of converter hood 402, allowing it to absorb more heat and convert more energy into radiated heat. In one embodiment, corrugated portions 508 include angles (e.g., angle 520) between 35 to 50° (e.g., 35 to 40°, 40 to 45°, [and] 45 to 50°), 50 to 60°, or 60 to 70°, or 25 to 35°. Corrugated portions 508 may include angles greater than 70° or less than 25°, for example. In one embodiment, corrugated portions 508 include 45° angles, increasing the area of converter hood 402 by a factor of 1.414. Corrugated portions 508 may also trap hot air and allow heat to be more evenly distributed along converter hood 402 than if, for example, converter hood 402 were not corrugated at all, which may result in more hot air accumulating at the top portion of converter hood 402. In another embodiment, corrugated portions may include curves rather than angles.

Flat portion 510 lacks corrugations, which may also help prevent hot air from accumulating at the top portion of converter hood 402. Like corrugated portions 508, flat portion 510 may allow heat to be more evenly distributed along converter hood 402 than if, for example, the top portion were corrugated.

FIG. 5C is a disassembled, cross-sectional drawing of exemplary converter hood 402. In this embodiment, converter hood 402 may include a first side portion 502-1, a second side portion 502-2, a first top portion 504-1, and a second top portion 504-2. Converter hood 402 may include more or fewer portions than shown. Portions 502-1, 502-2, 504-1, and 504-2 may allow for a more compact, disassembled converter hood 402 for easier transportation of radiant heater 400. Portions 502-1, 502-2, 504-1, and 504-2 may be rolled, drawn, or pressed into the shapes shown.

First side portion 502-1 may include corrugated portion 508 and first flange 506-1. First flange 506-1 may provide for rigidity along the length of converter hood 402. First flange 506-1 may also hold an insulation layer (not shown, discussed below) in place. Corrugated portion 508 may also provide for rigidity along the length of converter hood 402 in addition to the features discussed above. Second side portion 502-2 may include corrugated portion 508 and second flange 506-2, which may provide the same features as the corresponding elements of first side portion 502-1.

First top portion 504-1 may include corrugated portion 508 and flat portion 510. Likewise, second top portion 504-2 may include corrugated portion 508 and flat portion 510. Part of first top portion 504-1 may overlap with first side portion 502-1, allowing first top portion and first side portion 506-1 to be bolted together. Likewise, part of second top portion 504-2 may overlap with second side portion 502-2, allowing second top portion 504-2 and second side portion 502-2 to be bolted together. Part of first top portion 504-1 may also overlap with part of second top portion 504-2, allowing first top portion 504-1 and second top portion 504-2 to be bolted together. . . .

FIG. 6 is a cross-sectional drawing of a radiant heater 600 including an insulation layer 606. Radiant heater 600, like radiant heater 200, includes emitting tube 202, reflector 204, and converter hood 402. In one embodiment, emitting tube 202, space 206, reflector 204, space 404, and converter hood 402 may become hot. Insulation layer 606 may reside above converter hood 402. Insulation layer 606 may slow heat transfer in the upward direction and reduce heat loss. As a result, in this embodiment, insulation layer 606 may allow converter hood 402 to reach higher temperatures than without layer 606, allowing hood 402 to reradiate more energy with layer 606 than without layer 606. Converter hood 402 may hold insulation layer 606 in place using flanges 506-1 and 506-2 or other mechanical attachment means.

FIG. 7A is a plot of an involute curve 704 of a circle 702, which may be used to define first surface 204-1 and second surface 204-2 of reflector 204 in radiant heater 200. An involute curve may be obtained by attaching an imaginary, taut string to a first curve and tracing the string's free end as it is wound onto that first curve, thus creating the involute curve.

For example, assume that circle 702 is the first curve and that line 706-1 is a string 706 attached to circle 702 at a fixed point 708 on one end, and to a pencil 712 on the other end. Circle 702 may represent an emitting tube, such as emitting tube 202. In this example, the length of string 706 is the same as the circumference of circle 702. As string 706 is moved in a direction 710, string 706 becomes wound around circle 702 and pencil 712 traces involute curve 704. String 706 is shown in many positions (706-1, 706-2, etc.) as string 706 is wound around circle 702. Upon one complete revolution of string 706 around circle 702, involute curve 704 intersects circle 702 at point 708 because the length of string 706 is the same as the circumference of circle 702. Involute curve 704 may also be described as the unwinding of string 706 from circle 702.

One property of involute curve 704 is that tangents of circle 702 are perpendicular to involute curve 704. Because lines 706-1 through 706-11 are tangent to circle 702, lines 706-1 through lines 706-11 are all perpendicular to involute curve 704. FIG. 7B demonstrates another property of involute curve 704. For simplicity, FIG. 7B shows circle 702, involute curve 704, and tangent line 706-7 of FIG. 7A. In FIG. 7B, a line is drawn from the center of circle 702 to the intersection of involute curve 704 with tangent line 706-7. Because tangent line 706-7 is perpendicular to involute curve 704, an angle A between line 710 and involute curve is less than 90°, e.g., angle A is I degrees less than 90°. If line 710 were a heat wave, such as one of heat waves 210, then, according to Snell's Law, the angle of reflection is equal to the angle of incidence. Thus, a reflected wave 712 is R degrees (R equal to I) below tangent line 706-7. Being below tangent line 706-7 means that reflected wave 712 clears circle 702 (e.g., emitting tube 202). As shown, involute curve 704 may vary in distance to tangents of circle 702 (e.g., emitting tube 202), but the distance, in one embodiment, may not exceed one half of the circumference The relationship shown in FIG. 7B may apply to all lines (e.g., emitted waves 210) from the center of circle 702 (e.g., emitting tube 202). Thus, as shown in FIG. 7C, an emitted wave 710' is reflected away from circle 702 as reflected wave 712'.

FIG. 7D shows another involute curve 704', which is symmetrical to involute curve 704 along a center line 720. FIG. 7E shows involute curve 704 and involute curve 704' superimposed on each other. Finally, FIG. 7F shows only a portion of the superimposed involute curves 704 and 704', the portion shown having the characteristics of reflector 204 discussed above with respect to FIG. 2B. As discussed above, heat waves emitted from emitting tube 202 (e.g., circle 702) are reflected down and away from emitting tube 202. In addition, emitting tube 202 is spaced apart from reflector 204. 204 may also be referred to as a "bi-involute" reflector.

The spacing between emitting tube 202 and reflector 204 may be the result of fixed point 708 not being directly above the center of circle 702. For example, in FIGS. 7A through 7F, fixed point 708 is approximately 29° away from being directly above the center of circle 702. Other angles are possible, such as an angle between approximately 0-5°, 5-10°, 10-15°, 15-20°, 20-25°, 25-30°, 30-35°, etc. (e.g., 5n to 5n+5, where n is zero or a positive integer). Angles above 360° are also possible. Curves 704 and 704' (e.g., reflector 204) may formed by circle 702 with a diameter of approximately 76.1 mm. Other diameters are possible, such as between 5-10 mm, 10-20 mm, 20-30 mm, 30-40 mm, 40-50 mm, 50-60 mm, 60-70 mm, 70-80 mm, 80-90 mm, etc. (e.g., 10 u to 10 u+10 mm, where u is a positive integer).

As shown in FIG. 7F, the surfaces of reflector 204 may end a distance H above the bottom of emitting tube 202. In one embodiment, H is chosen such that direct heat waves 210 disperse as widely as possible, but do not impinge on converter hood 402. In other words, H may be (1) large enough such that a straight line from line source P to the space just below the bottom edge of converter hood 402 is unobstructed by reflector 204; and (2) small enough such that a straight line from line source P to the space just above the bottom edge of converter hood 402 is obstructed by reflector 204. In this embodiment, direct heat waves 210 are dispersed as widely as possible, and heat waves 210 that would otherwise impinge on converter hood 402 are reflected. This embodiment also allows for more radiated heat waves 406 (emitted by converter hood 402) to reach floor 208 without impinging on converter hood 402 (as compared, for example, to H being zero or extending below the edge of converter hood 402).

As discussed above, these properties of reflector 204 may increase the heating efficiency of radiant heater 200 and radiant heater 400. These properties may also allow the temperature of emitting tube 202 to be lower than in conventional systems (as compared to emitting tube 102, for example).

FIG. 8A is a diagram of an alternative involute curve 804 around circle 702. Involute curve 804 begins at fixed point 808, which is directly above the center of circle 702, unlike fixed point 708 which is not directly above the center of circle 702. FIG. 8B shows another involute curve 804', which is symmetrical to involute curve 804 along a center line 820. FIG. 8C shows involute curve 804 and involute curve 804' superimposed on each other. Finally, FIG. 8D shows only a portion of the superimposed involute curves 804 and 804' (e.g., reflector 204'), the portion shown having the characteristics similar to reflector 204 discussed above with respect to FIG. 2B. As discussed above, heat waves emitted from emitting tube 202 (e.g., circle 702) are reflected by reflector 204' down and away from emitting tube 202. In the design of reflector 204', however, the distance between emitting tube 202 and reflector 204' is less than with reflector 204. With reflector 204', however, an emitter tube may be used that has a smaller radius than emitting tube 202. In this case, the smaller emitter tube may be spaced farther from reflector 204', but may still have the same center as circle 702.

As discussed above, reflector 204/204' allows for more reflected energy to pass around emitting tube 202. The shape of reflector 204/204' may help reduce heat buildup under the reflector. Reducing heat under reflector 204/204' may result in lower temperatures on the hottest points of emitting tube 202. Thus, reflector 204/204' may increase the reflection efficiency and may increase the radiant efficiency of a heater. This greater efficiency may increase the reliability of the heater and the lifetime of the heater, as component temperature (e.g., the temperature of emitting tube 202) may be reduced. Because reflector 204/204' may reduce temperatures, relative to reflector 104, reflector 204/204' may allow an increased heat input to achieve the same reliability as reflector 104.

Returning to FIG. 2B, junction 220 is directly above emitting tube 202. A central axis (not shown) passes through source point P (the center of emitting tube 202) and junction 220. Surface 204-1 is such that radiation impinging on reflector 204 closer to junction 220 (and the central axis) is reflected (in its first reflection) farther away from the central axis than radiation impinging on reflector 204 farther away from junction 220. In other words, the reflected radiation creates the cross pattern shown in FIG. 2B. "Farther away," in this example means that the reflected energy (in the direction of its first reflection that does not cross the central axis) impinges floor 208 farther away from the central axis.

In addition, as shown in FIG. 2B, radiation is distributed across floor 208. In one embodiment, first surface 204-1 provides for a substantially even distribution of the reflected radiated energy—including areas directly under emitting tube 202 as well as outside the umbrella of reflector 204. . . .

As discussed above, in one embodiment, reflector 204 comprises a first sheet 302-1 and a second sheet 302-2 joined by multiple joining strips 310. In this exemplary embodiment, first sheet 302-1 and second sheet 302-2 do not include flange 306-1 and flange 306-2. Instead, an air gap may separate first sheet 302-1 and second sheet 302-2 (e.g., at junction 220), where the air gap is interrupted by joining strips 310. In this embodiment, heat transfer may occur through convection by air passing from space 206 to space 404 through the air gap between first and second sheets 302-1 and 302-2. In this embodiment, reflected radiation may not be reduced significantly because it is at junction 220 where radiation may otherwise reflect downward toward emitting tube 202. Converter hood 402 may include an angle immediately above junction 220 to reflect any radiation away from emitting tube 202. Alternatively, converter hood 402 may include a material directly above junction 220 to absorb the energy emitted by emitting tube 202 so that captured energy may be re-radiated from converter hood 402. Air gaps or holes may also be placed in other locations on reflector 204, such as periodically at the highest points of reflector 204 along its length.

In another embodiment, reflector 204 and/or emitting tube 202 may be suspended from converter hood 402 by a suspension mechanism (e.g., cables or long bolts). In this embodiment, heat may be transferred by conduction of heat along the suspension mechanism directly from reflector 204/space 204 to converter hood 402. In another embodiment, reflector 204 and/or emitting tube 202 may be connected to converter hood 402 through a metal conductor (other than a suspension mechanism) to transfer heat by conduction from reflector 204 and/or emitting tube 202 to converter hood 402.

In one embodiment, reflector 204 may be approximately 300 mm wide from edge to edge and 100 mm tall. In one embodiment, converter hood 402 may be approximately 700 mm wide from edge to edge and 170 mm tall. . . .

For example, reflector 204 may be used in a radiant heater without the use or converter hood 402. In this example, an insulation layer (not shown) may be laid above reflector 204 to slow the heat transfer upward to reduce heat loss. Is another example, converter hood 402 may be used with reflectors of any shape, including reflector 104 of radiant heater 100. As another example, a curved surface other than a circle (e.g., an ellipse) may be used to create the involute shape of reflector 204, even though emitting tube 202 is still a circle. In this example, emitting tube 202 may still be within the radiation-free envelope created by the involute curved surface. Further, shapes that approximate or are substantially similar to the shape of reflector 204 and reflector 204' are possible.

As another example, first lip 304-1 and second lip 304-2 of reflector 204 may include another bend inward toward first sheet 302-1 and second sheet 302-2, respectively. In this embodiment, radiation 406 emitted by converter hood 402 may reflect away from reflector 204 rather than being trapped in the area formed by lips 304 and sheets 302.

As yet another example, in one embodiment, reflector 204 and converter hood 402 may both be mounted on the same support structure such that the spatial relationship between the two remains the same. In another embodiment, reflector 204, converter hood 402, and emitting tube 202 may be mounted on the same support structure such that the spatial relationship between the three remains the same. In another embodiment, emitting tube 202 and reflector 204 may be mounted on the same support structure so that the spatial relationship between the two remains the same. In this embodiment, reflector 204, converter hood 402, and/or emitting tube 202 may be sold, packaged, and shipped in a manner convenient for installation. In one embodiment reflector 204 and converter hood 402 may be integrally formed."

In U.S. Pat. No. 7,489,858; Zank et al. wrote, "Reflector is positioned and designed to widen the heat pattern radiated (projected, dispensed, etc.) from heating unit. Reflector comprises an elongate member configured to extend opposite to heating element so as to reflect heat emitted by heating element. Reflector generally includes spine, wings and wingtips. Spine generally functions as a backbone of reflector and extends parallel to heating element. Wings obliquely extend from spine and cooperate with spine to provide a majority of a reflecting surface about heating element. Wingtips extend from wings, respectively, and are configured to cooperate with flanges of main body and housing to cover and conceal the volume between reflector and main body. Elongate bores are formed along a junction of wing and wingtip and along a junction of wing and wingtip, respectively. One of bores are configured to align with holes depending on the orientation of ends coupled to main body.

In the particular embodiment shown, spine, wings and wingtips are integrally formed as a single unitary body out of a metal such as aluminum. . . . [R]eflector has a uniform cross-section (but for openings which are cut) along its entire axial length, enabling reflector to be formed using an extrusion process. In alternative embodiments, reflector may be formed from other materials, may be formed from individual structures which are welded, bonded, fastened or otherwise connected to one another, or may be formed from one or more different manufacturing techniques. According to an exemplary embodiment, reflector has a shiny or glossy surface that reflects heat energy. According to a particularly preferred embodiment, the reflector is bright-anodized to inhibit or prevent it from darkening or tarnishing or otherwise degrade over time." (Column 4, line 10 to 40; call out numbers were deleted and bracketed letter was capitalized only).

In U.S. Pat. No. 5,626,125; Eaves discloses a radiant tube space heater wherein "the place of the normal reflector is taken by a heat projection cowling. The bottom of the cowling is open, its lower edges being approximately on a common level with the lowermost periphery of the heating tube; it also has upwardly convergent side walls and a flat horizontal top wall. The cowling's walls are spaced away from the tube. The cowling has an insulation material on its exterior surface, relative to the tube. Positioned between the cowling flat horizontal top wall and the tube is a thermally insulating shield formation.

Common features of the above-identified cowlings, reflectors, shields, and hoods are that they each have terminal ends 13 that (a) bend upwards and away from the tube to form lips, (b) terminate without any bends, or (c) bend inwards toward the tube.

Detroit Radiant manufactures various high intensity infrared heaters that are sometimes referred to as high intensity/ceramic infrared heaters. According to Detroit Radiant's DR Series Manual, its heater assembly has a heat shield, a rayhead assembly with ceramic, a side frame, a brass union, a manifold pressure tape, a manifold end frame assembly, a gas orifice, a pilot or electrode assembly, a reflector shield, rods, a high voltage wire, a low voltage wire, a circuit board, a gas valve, a cross-over bracket, a side frame, an electrode bracket, a ceramic tile, a pilor burner, a pilot orifice, a powerpile, and a pilot shield. Common features of these high intensity/ceramic infrared heaters are that the reflector heat shield defines the heater's perimeter like the above-identified heaters and the reflector heat shield has terminal ends that (a) bend upwards and away from the tube to form lips, (b) terminate without any bends, or (c) bend inwards toward the tube.

Many other heaters that direct heat toward the ground wherein the heaters are above t ground and are, when in position to direct the heat toward the ground, either vertical to the ground or at an angle to the ground, have a reflector with terminal ends that (a) bend upwards and away from the tube to form lips, (b) terminate without any bends, or (c) bend inwards toward the tube. Those other heaters include and are not limited to the above-identified heaters and patio heaters, and others known to those skilled in the art.

The objective of the present invention is to make the above-identified radiant heaters more efficient.

SUMMARY OF THE INVENTION

A conventional radiant heating apparatus has a heat transfer apparatus and a partial enclosure device. To make that conventional radiant heating apparatus more efficient, the conventional radiant heating apparatus has a heating wing.

The heat transfer apparatus transports a hot fluid, the hot fluid transfer its heat energy to the heat transfer apparatus, and the heat transfer apparatus radiates heat energy toward a desired object in a first direction. An example of a heat transfer apparatus includes, and not limited to, a tube. The hot fluid can be a gas or a liquid; and it is heated by conventional apparatuses used in conventional heating apparatuses. The partial enclosure device partially encloses at least a portion of the transport apparatus. The partial enclosure has an opening that exposes at least a portion of the transport apparatus. The opening permits the heat energy to radiate heat energy in a first direction, and unfortunately roll out the opening toward a second direction. The partial enclosure also acts as a reflective interior surface. The reflective interior surface re-directs (a) much of the heat energy that contacts the reflective interior surface in the first direction through the opening and (b) some heat energy that contacts the reflective interior surface in a second direction opposite the first direction after the heat energy passes through the opening—a.k.a., rolls-out heat energy.

The heating wing can be positioned above or just above the opening's perimeter and on the partial enclosure device's exterior surface. The heating wing can be positioned along a single side or multiple sides of the partial enclosure. For example, on one side of the partial enclosure the heating wing can be (a) a single heating wing unit that extends the length of the partial enclosure's side, or (b) two or more units wherein each adjacent heating wing unit overlaps or contacts each other, or spaced from each other, or combinations thereof.

The heating wing also has a wing distal end that obliquely extends outwardly in relation to the partial enclosure device and toward the first direction. The heating wing, except at the wing proximal end, and the partial enclosure device's exterior surface are spaced apart so the heating wing re-directs the rolled-out heat energy toward the first direction.

DETAILED DESCRIPTION OF THE INVENTION

The present invention improves the radiant heating efficiency of a conventional radiant heater 100 as illustrated in the prior art FIGS. 1-8. A conventional radiant heater 100 has a heat transfer apparatus 102 and a partial enclosure device 14 as illustrated at FIGS. 9A-D. The partial enclosure device 14 can be or have a reflector device, a converter hood, a cowling device, a shield device or mixtures thereof as illustrated at FIGS. 9A-D.

Figure 9A:
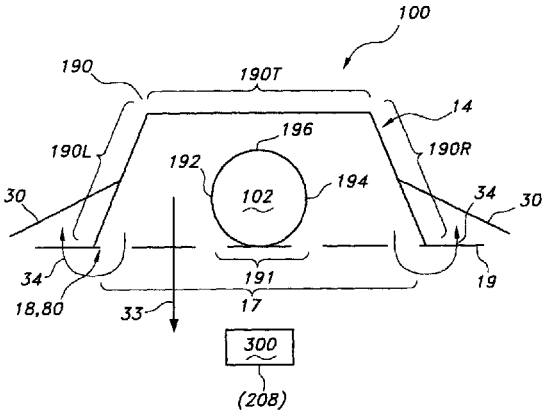
FIGS. 9A through 9D illustrate cross-sectional views of various embodiments of the current invention.
Figure 9B:
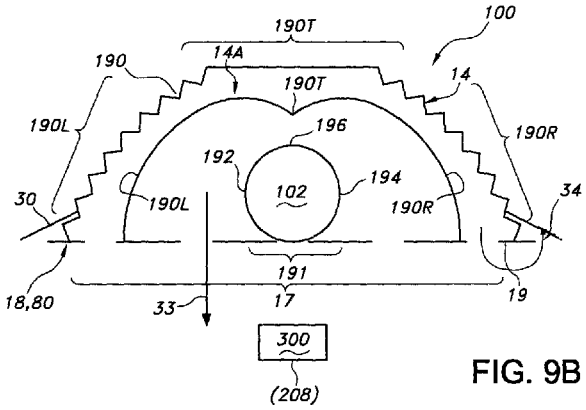
Figure 9D:
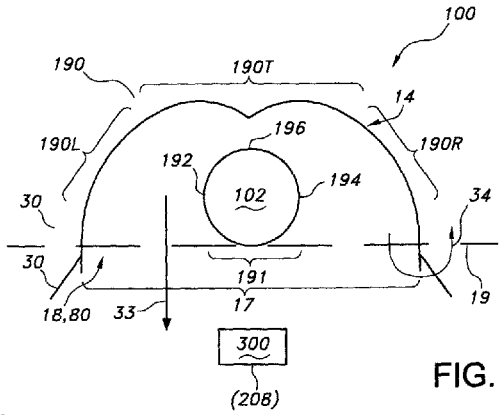
Figure 9C:
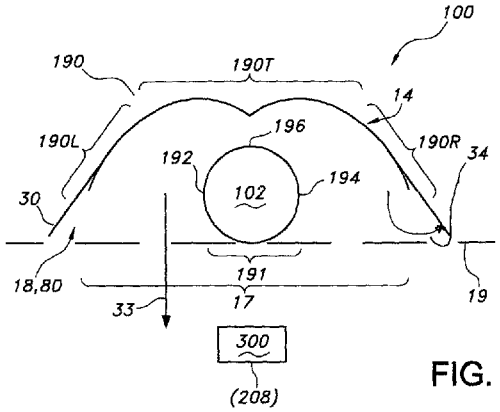
Figure 10:
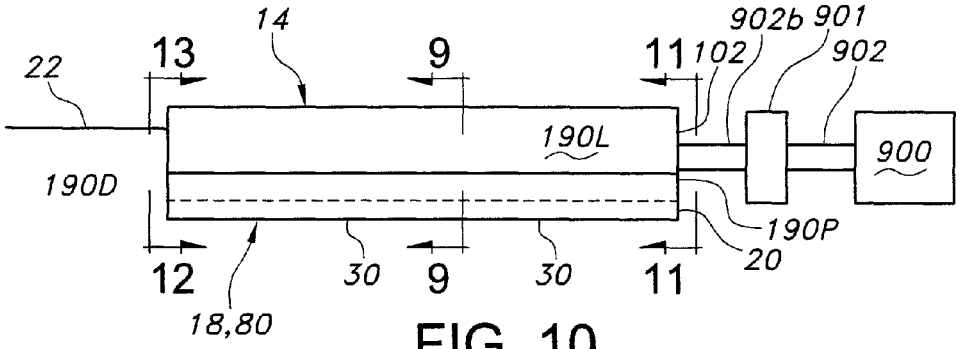
FIG. 10 illustrates a side view of FIG. 9A.
Figure 11A:
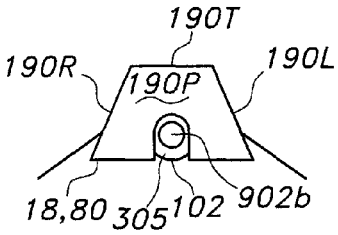
FIGS. 11A and B illustrate a view of FIG. 10 taken along the lines 11-11 of different versions thereof.
Figure 11B:
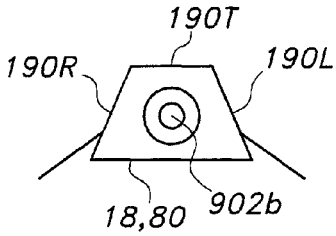
Figure 12:
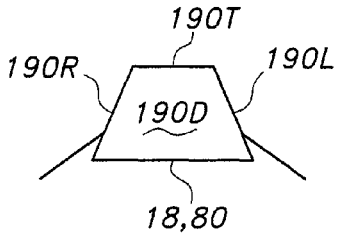
FIG. 12 illustrates a view of FIG. 10 taken along the lines 12-12.

The heat transfer apparatus 102 normally transports a hot fluid, the hot fluid transfers its heat energy to the heat transfer apparatus 102 and the heat transfer apparatus 102 radiates heat energy toward a desired object in a first direction 33 as illustrated at FIGS. 9A-D. An example of a heat transfer apparatus includes, and not limited to, a tube. The hot fluid can be a gas or a liquid (normally converted into a gas when it is ignited or hot flue gas); and it is heated and/or ignited by conventional burner apparatus and instruments used in conventional heating apparatuses. The conventional burner apparatus and instruments used in a radiant heater include, and are not limited to, a fuel source 900 (that normally provides natural gas, propane or other conventional heating fuel—but it can also be electricity in an alternative embodiment) that transmits the fuel through a conduit 902 to an air/ignition manifold unit 901 that heats the fuel to a desired temperature hot fluid and then transfers the hot fluid and its inherent heat energy to the heat transfer apparatus 102 with the possibility of a second conduit 902*b* positioned between the air/ignition manifold unit 901 and the heat transfer apparatus 102, as illustrated at FIGS. 10 and 11A-B. Alternatively in relation to a different embodiment, the heat transfer apparatus 102 could be an electric resistor system that radiates heat toward the desired object; thereby the fuel source can be electricity.

The partial enclosure device 14, as described above and illustrated at FIGS. 9A-D, partially encloses the heat transfer apparatus 102 which can be an emitting tube. In addition, a second partial enclosure device 14*a*, as illustrated at FIG. 9B can be positioned between the emitting tube 102 and the partial enclosure device 14. The partial enclosure device 14 and the second partial enclosure device 14*a* can be straight, curvilinear, corrugated, any of the designs illustrated in the above-identified prior art, or combinations thereof.

Each partial enclosure device 14, 14*a*, has an opening 17, as clearly illustrated at FIGS. 9A-D, that exposes at least a portion of the transport apparatus 102 and defines the partial enclosure device's perimeter 80—a complete perimeter when the radiant heater 100 has an end cap 190D, 190P, and partial perimeter when the radiant heater 100 has no or just one end cap 190D, 190P. The opening 17 permits heat energy to radiate heat energy in a first direction 33, and unfortunately roll out the opening toward a second direction 34—not in the first direction toward a desired object 300. The opening 17 is defined by sides 190, and at a minimum and in particular sides 190L, 190T, 190R. Sides 190L, 190R and 190T are respectfully positioned—in relation to the first direction 33 and with the understanding that the heat transfer apparatus' exposed surface is its bottom surface 191—a predetermined distance from the heat transfer apparatus' left surface 192, right surface 194, and top surface 196. Optionally, the sides 190 can also include a proximal side 190P that surrounds (see FIG. 11B) or partially surrounds (see FIG. 11A) conduit 902*b* or, alternatively, an area near the heat transfer apparatus' proximal end 305 that connects to the conventional burner apparatus, and/or a distal side 190D that is positioned a pre-determined distance from the heat transfer apparatus' distal end (not shown). It is understood that the sides 190 can be made from a unitary sheet of metal or a plurality of sheets of metal connected together. It is understood that the heat transfer apparatus 102, the partial enclosure device 14, and the conventional burner apparatus are known to those having ordinary skill in the art.

The opening's 17 perimeter 80 is defined by a terminal end 18 of the sides 190L, 190R, and optionally sides 190D and 190P if they are used. The terminal end 18 can be positioned (a) above a radiation reference plane 19—as defined in CAN/ANSI/AHRI 1330-2015, *Performance Rating for Radiant Output of Gas Fire Infrared Heaters,*

(b) at the radiation reference plane 19 (see FIG. 9A, B), or (c) below the radiation reference plane 19 (see FIG. 9D).

Figure 13A:
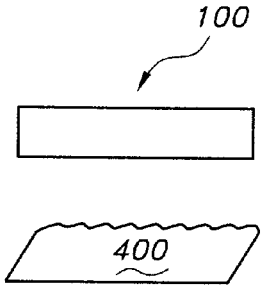
FIGS. 13A-E illustrate alternative positioning of a radiant heater.
Figure 13B:
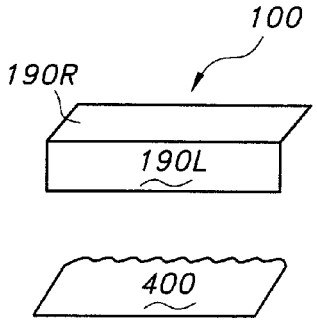
Figure 13C:
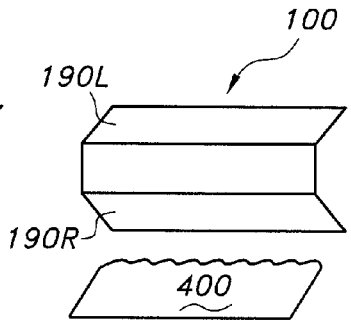
Figure 13D:
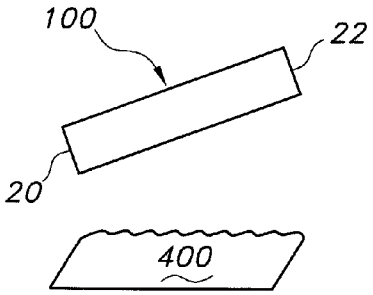
Figure 13E:
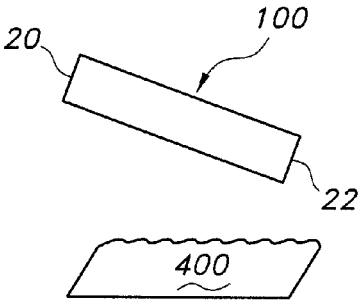

Likewise, the radiant heater 100 (see FIG. 10) has a proximal end 20 and a distal end 22 (with or without sides 190P, 190D, respectively). The radiant heater 100 can be parallel to the ground 400 (see FIG. 13A) or at an angle relative to the ground. The angle can have the left surface 190L lower than the right surface 190R (FIG. 13B), the right surface 190R lower than the left surface 190L (FIG. 13C), the proximal end 20 lower than the distal end 22 (FIG. 13D), the distal end 22 lower than the proximal end 20 (FIG. 13E) or variations thereof. The objective is that the radiant heater's opening 17 is directed in a first direction 33 to radiate heat energy to a desired object.

The crux of this invention is to improve the radiant heating efficiency of the radiant heater 100, for example and not limited to the above-identified radiant heaters. The improvement improves the heating efficiency by about 3 to 4 percentage points as measured by a radiant efficiency measurement apparatus that abides to a conventional industry standard described in a manual identified as CAN/ANSI/AHRI 1330-2015, *Performance Rating for Radiant Output of Gas Fire Infrared Heaters*. That percentage may be altered by percentages due to the different radiant heaters and angles that the radiant heaters are positioned. Instead of repeating or re-iterating what is disclosed above about radiant heaters and in the background of the invention and which is known to those of ordinary skill in the art, applicant elects to focus on components not previously disclosed and why those components render the instant invention superior.

Heating Wings

Figure 14A:
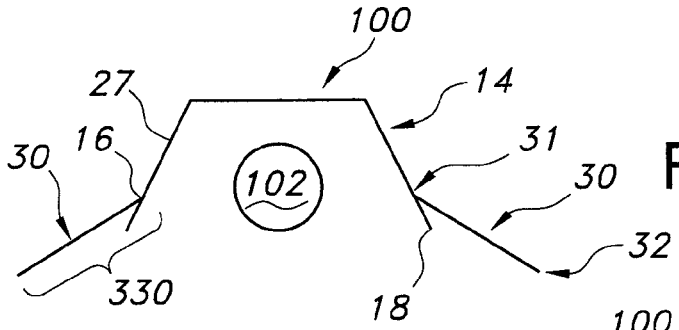
FIGS. 14A-D illustrates alternative positioning of a heating wing(s) 30 on a radiant heater.

The increased radiation efficiency is accomplished by a heating wing 30 on any of the above-identified radiant heaters 100 described above, in the background of the invention or any other radiant heater. Each heating wing 30 has a wing proximal end 31 and a wing distal end 32 in relation to its width 330 (see FIG. 14A) and a close end 34—positioned at, near or toward the partial enclosure device's proximal end 20—and a distant end 35—positioned at, near or toward the partial enclosure device's distal end 22—in relation to its length 36 (see FIG. 14B).

Figure 14B:
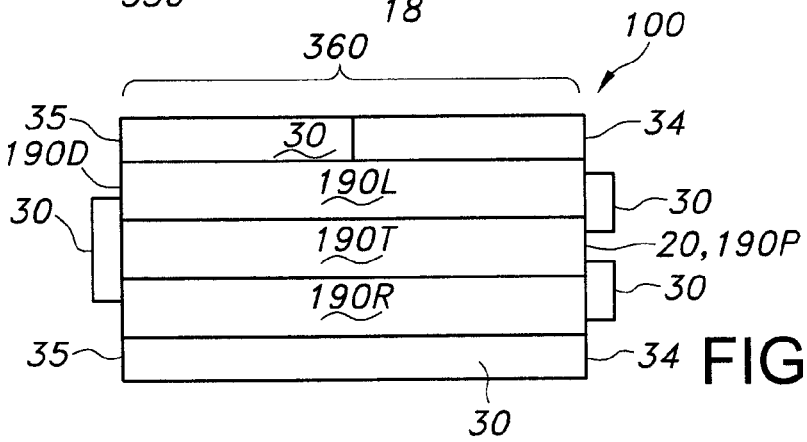
Figure 14C:
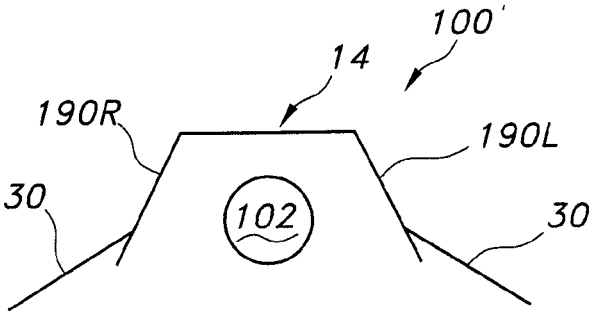
Figure 14D:
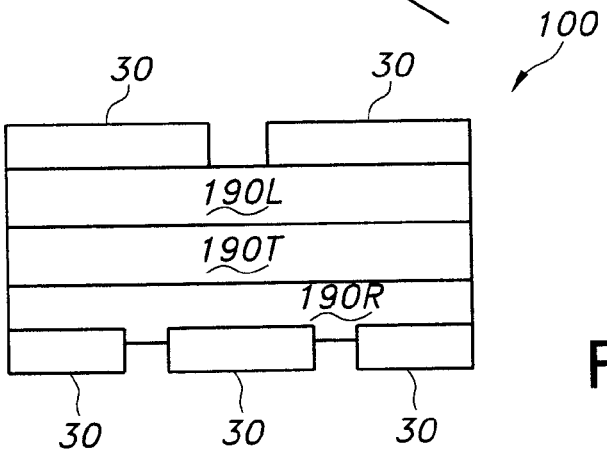

Each wing proximal end 31 extends from an exterior surface 27 of the partial enclosure device 14 at a predetermined distance (referred to as the contact point 16) above the radiant heater's respective terminal end 18. The contact point 16 can be (1) an identical predetermined distance on every side 190R, 190L (and optionally 190P, and 190D if the end caps are used and heating wings are positioned thereon) as illustrated at FIG. 14B, (2) a different predetermined distance on every side—for example and not limited to 0.01 cm on side 190R but 5 cm on side 190L as represented at FIG. 14C, (3) varied on each specific side—for example and not limited to a proximal heated wing on side 190 R has a predetermined distance of 1 cm and a distal heated wing on side 190R has a predetermined distance of 10 cm as illustrated at FIG. 14D; or (4) combinations thereof. The contact point 16 can be, for example and not limited to, 0.001 to 30 cm above the radiant heater's terminal end(s) 18 with the understanding that the contact point 16 is dependent on the size of the partial enclosure device 14, dimensions of the heating wing 30, desired angle of the wing relative to the exterior surface 27 at the contact point, and the desired distance of the wing's distal end 32 from the radiant heater's terminal end 18.

As also illustrated at FIG. 14D, the heating wings 30 can be spaced apart as illustrated from side 190R; overlap each other as illustrated from side 190L; and abut (as illustrated at FIG. 14B alongside 190L) another heating wing 30. All of these embodiments can be used in relation to any side 190R, 190L, 190P, and/or 190D.

Figure 15:
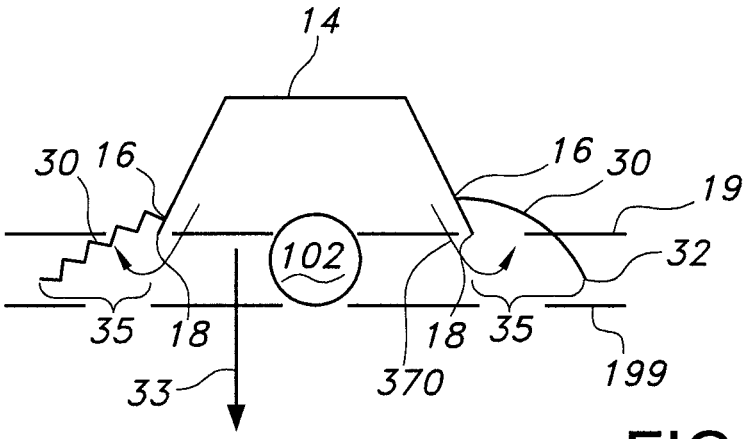
FIGS. 15 and 16 illustrate alternative heating wings on a radiant heater.

From the contact point 16, heating wing 30, overall, obliquely extends (a) outwardly in relation to the partial enclosure device 14 and (b) toward the first direction. Admittedly, the heating wing 30 could be straight (see FIGS. 14A and C), curvilinear (see FIG. 15), sinusoidal, have a step configuration (a.k.a., corrugated) (see FIG. 15), various other configurations and combinations thereof. That means, the heating wing 30, overall, does not extend in a direction parallel to the radiation reference plane 19 nor opposite the first direction. Otherwise, the heating wing 30 does not provide the desired increased radiant heating efficiency.

Figure 16:
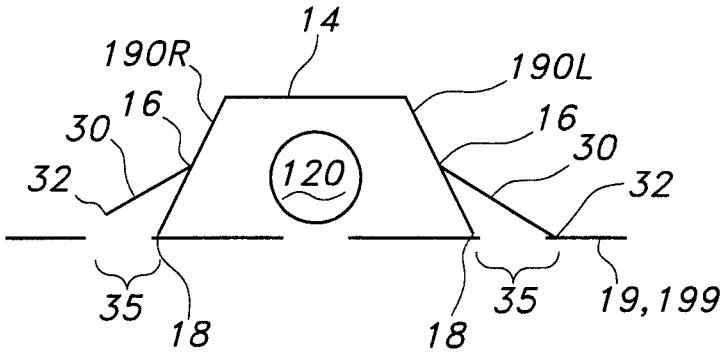

In view of the above-identified position restrictions concerning the heating wing 30, the distal end 32 terminates along the radiation reference plane 19 (see FIG. 16), above the radiation reference plane 19 (see FIG. 16), below the radiation reference plane 19 (see FIG. 15) or combinations thereof,—the reference plane 199, as of today, remains the lowest point of the radiant heater for measurement purposes. Preferably the distal end 32 terminates along the radiation reference plane 19, or below the radiation reference plane 19 to obtain the desired increased radiant heating efficiency. Moreover, the distal end 32 terminates a predetermined spacing 35 (for example 1 to 50 cm, preferably 5 to 40 cm, and most preferably about 10 cm; and the predetermined spacing is dependent on the size of the partial enclosure device 14, dimensions of the heating wing 30, desired angle of the wing relative to the exterior surface 27 at the contact point) from a corresponding terminal end 18. Thus, the angle between the wing 30 material (not including the contact point 16) and the exterior surface 27 is between and including 5 and 85°, more preferable between and including 30 and 60°; most preferably 35 and 55°; with the understanding that 45° provides excellent results to obtain the desired increased radiant heating efficiency.

The predetermined spacing can be filled with air or conventional insulation used in the radiant heating industry. It is preferred, however, the predetermined spacing be filled with air to maximize the reflecting capacity of the heating wings 30.

The wing 30 attaches to the partial enclosure device 14 by adhesives, screws, clamps, welding, rivets, tongue-in-slot configuration, snaps, hook/loop, other known fastening components, or combinations thereof on any desired side surface, which can be surfaces 190R, 190L, 190D, 190T, and/or 190P (as illustrated at FIG. 14B, of the partial enclosure device 14 so the reflector and wing are integral components of each other. Likewise, the wing and reflector can be removable components through other conventional connection means, such as and not limited to tongue-in-slot configuration, snaps, hook/loop.

The wing 30 can be made of the same reflective material as the partial enclosure device 14, 14*a* or a different reflective material as the partial enclosure device 14, 14*a*; or be a plurality of wings 30 spaced apart from or overlapping each other wing 30. The wing 30 can be a single reflector piece extending the length of the partial enclosure device 14 (see FIG. 14B); alternatively, the wing 30 can be a plurality of reflector pieces that collectively extend the length of the partial enclosure device 14 (see FIG. 14B) or combinations thereof (see FIG. 14). In any case, the wing 30 is designed to operate in the same manner as the partial enclosure device—reflect radiant energy in the first direction toward an object or objects that are to be warmed or an area that is to be warmed.

One may wonder why this embodiment is superior to the embodiments illustrated in the cited prior art Figures. Notice that the terminal ends of the partial enclosure device illustrated in the cited prior art Figures have the ends terminate with a lip—that protrudes upward in a direction opposite the first direction—or, as not illustrated, no lip. The lip and no lip embodiments permit some radiant energy (arrows 370 in FIG. 15) to escape or leak around, for example by turbulence, the partial enclosure device's and, as a result, the radiant heater's confines.

The wing 30 may also seem, on first blush, to be a simple invention that seems rather obvious. Nothing could be further from the truth. As identified in the above-identified background of the invention, those of ordinary skill in the radiant heating art have attempted to increase heating efficiency in many ways—adding insulation to the reflector's exterior surface, providing air gaps or insulation between the reflector and the hood, corrugating the reflectors to direct the radiant heat in the desired direction, and adding insulation immediately above the heating elements. None of those prior embodiments, however, re-direct the turbulent radiant energy in the first direction.

Figure 1A:
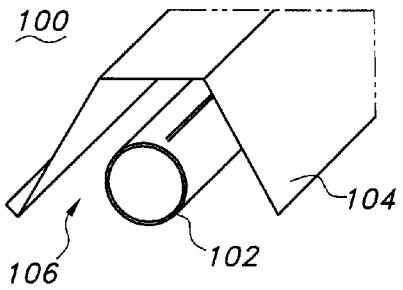
FIG. 1A (PRIOR ART)
FIG. 1A (prior art) is a diagram of a radiant heater.
Figure 1B:
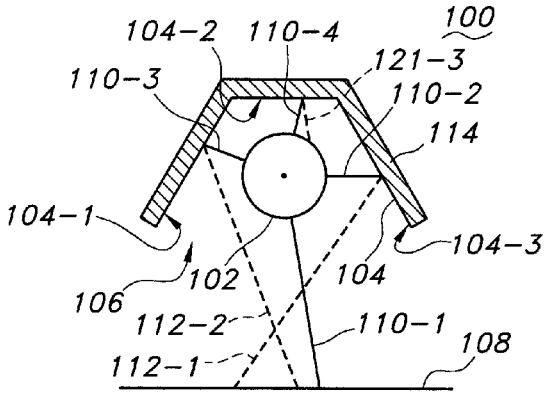
FIG. 1B (PRIOR ART)
FIG. 1B (prior art) is a cross-sectional drawing of the radiant heater of FIG. 1A.
Figure 2A:
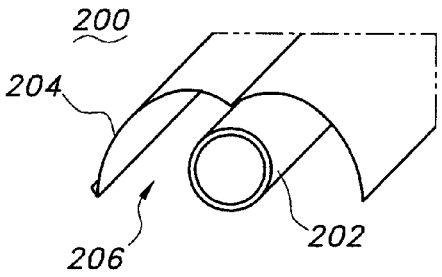
FIG. 2A (PRIOR ART)
FIG. 2A (prior art) is a diagram of an exemplary embodiment of a radiant heater.
Figure 2B:
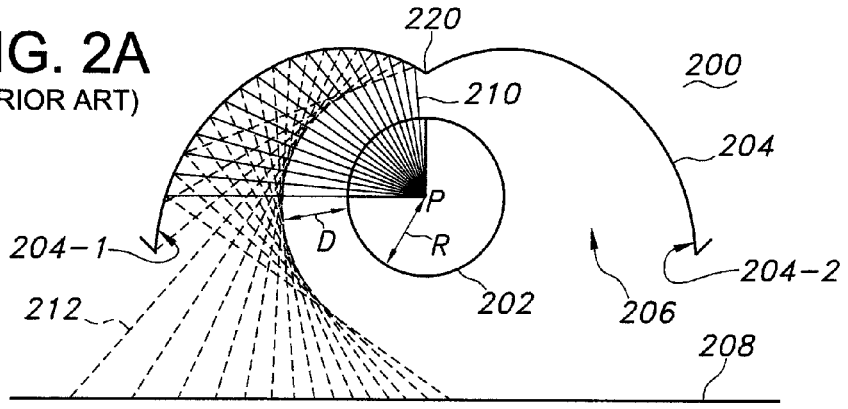
FIG. 2B (PRIOR ART)
FIG. 2B (prior art) is a cross-sectional drawing of the exemplary radiant heater of FIG. 2A.
Figure 3A:
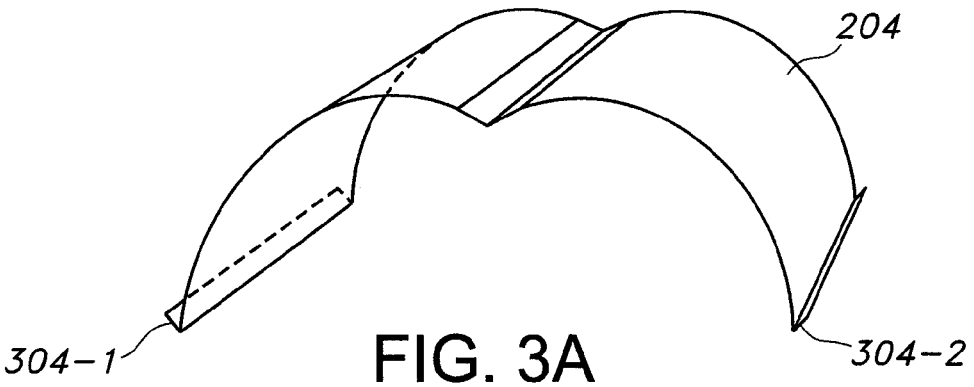
FIG. 3A (PRIOR ART)
FIG. 3A (prior art) is a perspective drawing of an exemplary embodiment of a reflector in the exemplary radiant heater of FIGS. 2A and 2B.
Figure 3B:
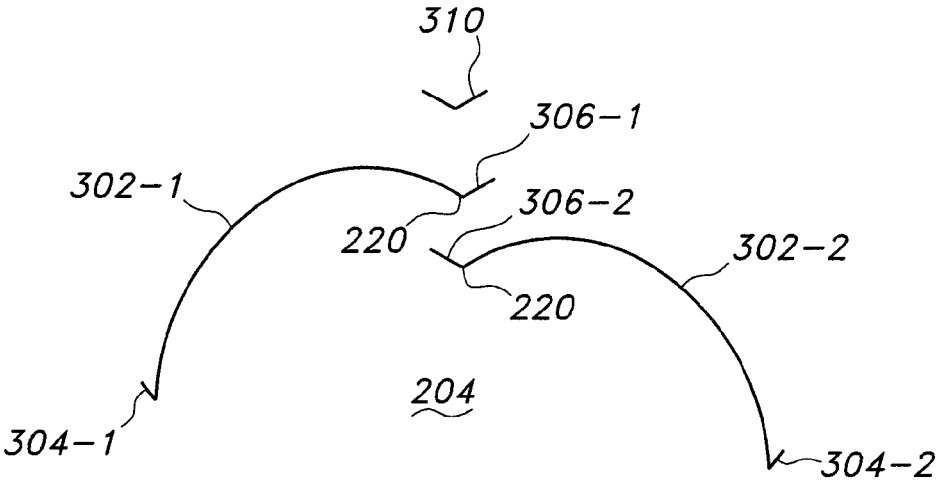
FIG. 3B (PRIOR ART)
FIG. 3B (prior art) is a disassembled, cross-sectional drawing of the exemplary reflector of FIG. 3A.
Figure 4A:
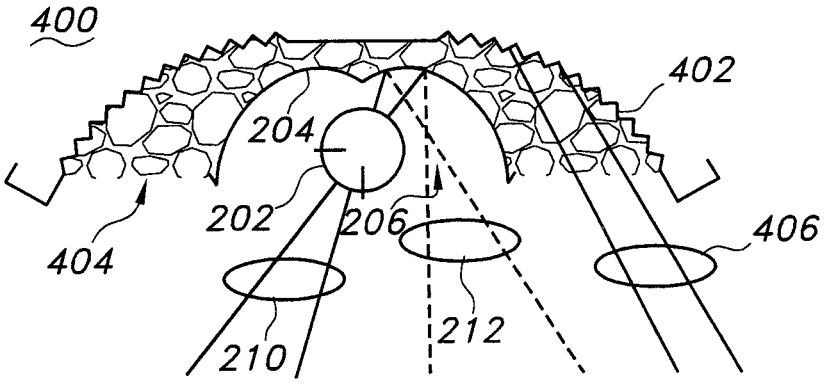
FIG. 4A (PRIOR ART)
FIG. 4A (prior art) is a cross-sectional drawing of an exemplary embodiment of a radiant heater with a heat converter hood.
Figure 4B:
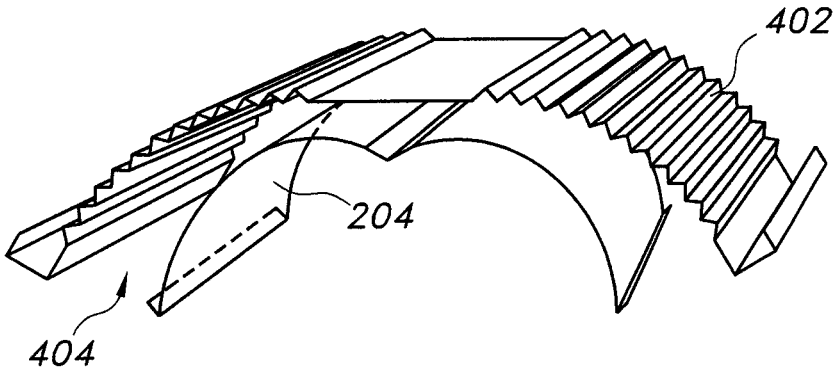
FIG. 4B (PRIOR ART)
FIG. 4B (prior art) is a perspective drawing of the exemplary reflector and exemplary heat converter hood of the radiant heater of FIG. 4A.
Figure 5A:
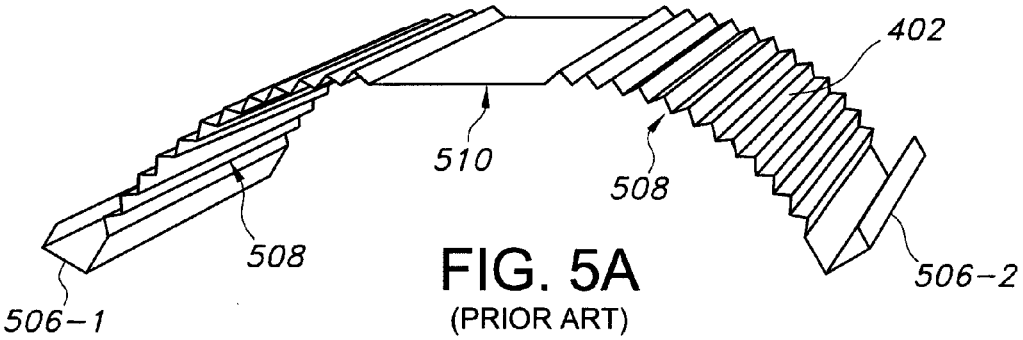
FIG. 5A (PRIOR ART)
FIG. 5A (prior art) is a projection drawing of an exemplary converter hood of the radiant heater of FIG. 4A.
Figure 5B:
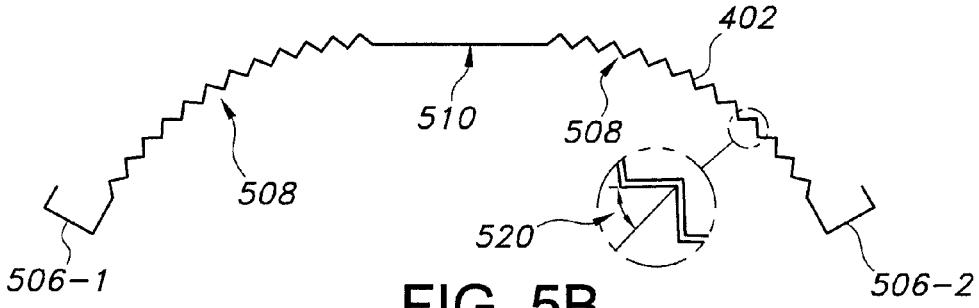
FIG. 5B (PRIOR ART)
FIG. 5B (prior art) is a cross-sectional drawing of the exemplary converter hood of FIG. 5A.
Figure 5C:
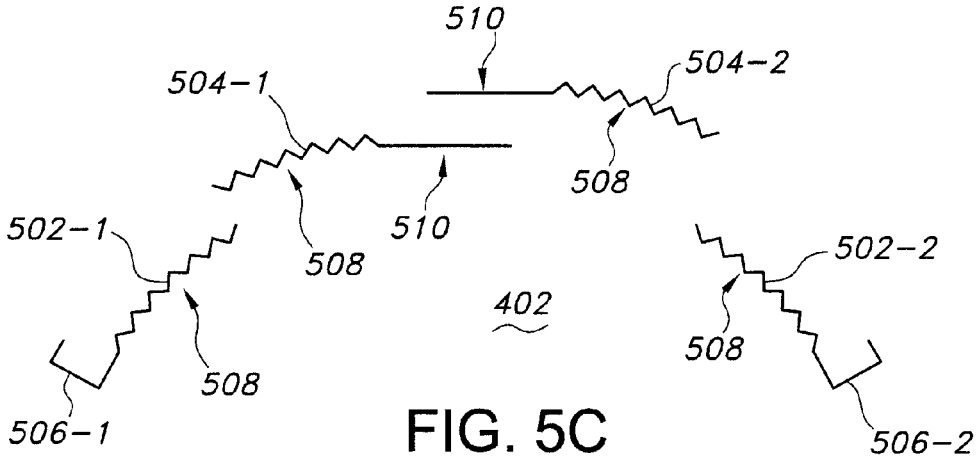
FIG. 5C (PRIOR ART)
FIG. 5C (prior art) is a disassembled, cross-sectional drawing of the exemplary converter hood of FIG. 5A.
Figure 6:
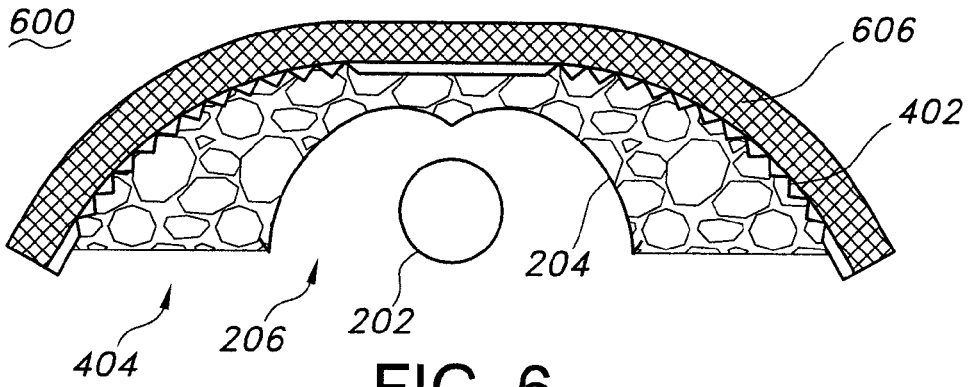
FIG. 6 (PRIOR ART)
FIG. 6 (prior art) is a cross-sectional drawing of an exemplary embodiment of a radiant heater including an insulation layer.
Figure 7A:
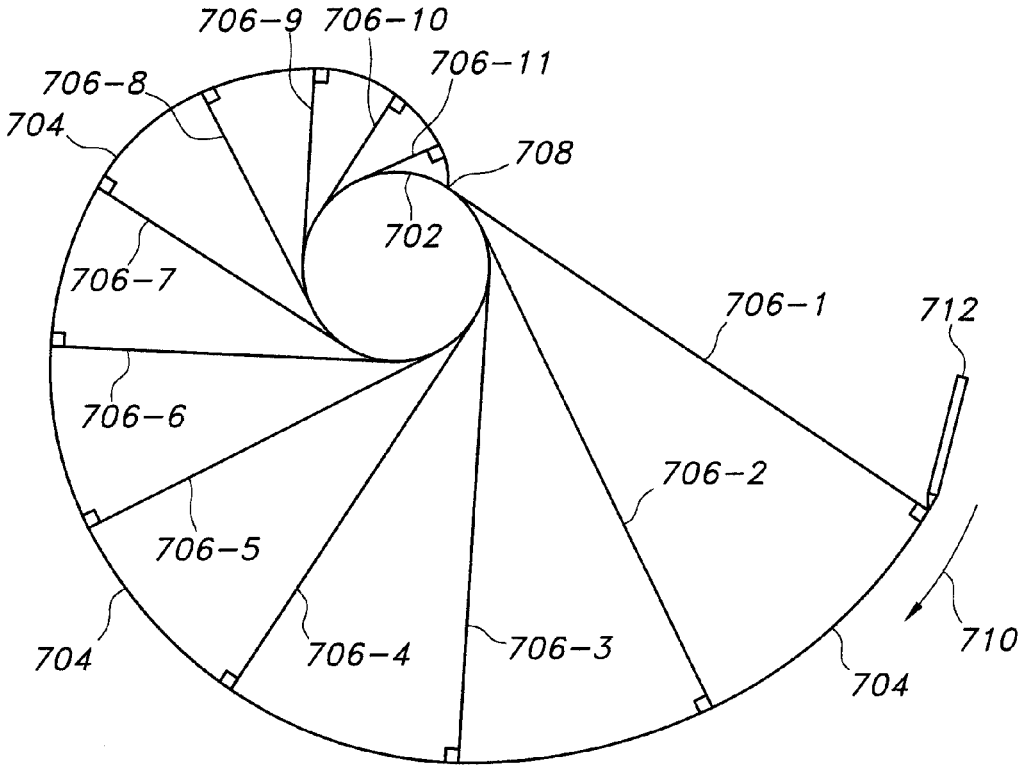
FIG. 7A (PRIOR ART)
FIGS. 7A through 7F (prior art) are plots of exemplary curves that describe the reflector of FIG. 3A.
Figure 7B:
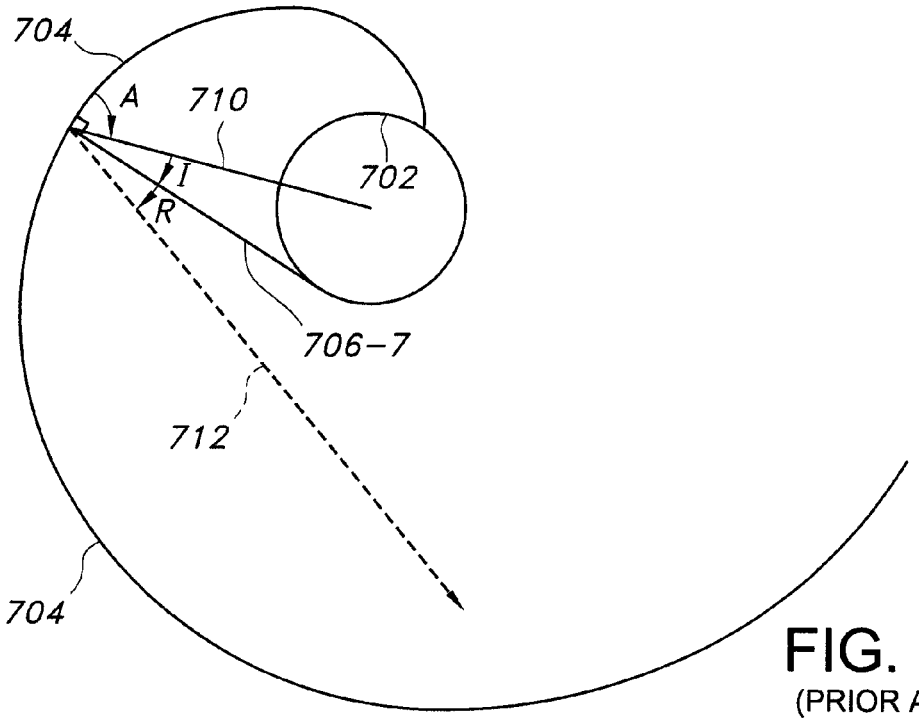
FIG. 7B (PRIOR ART)
Figure 7C:
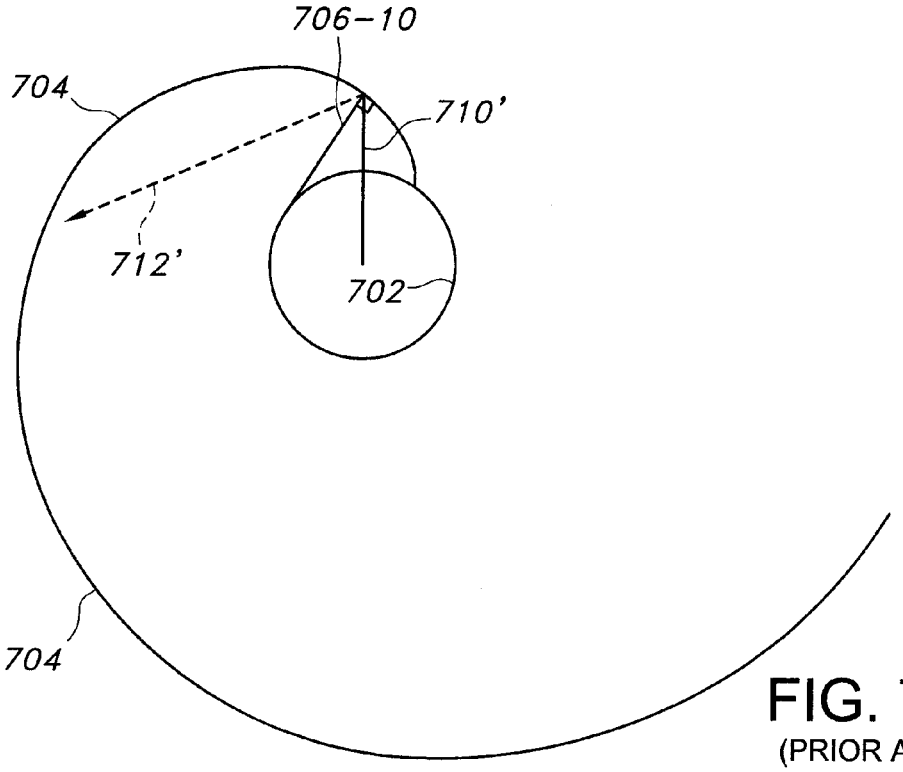
FIG. 7C (PRIOR ART)
Figure 7D:
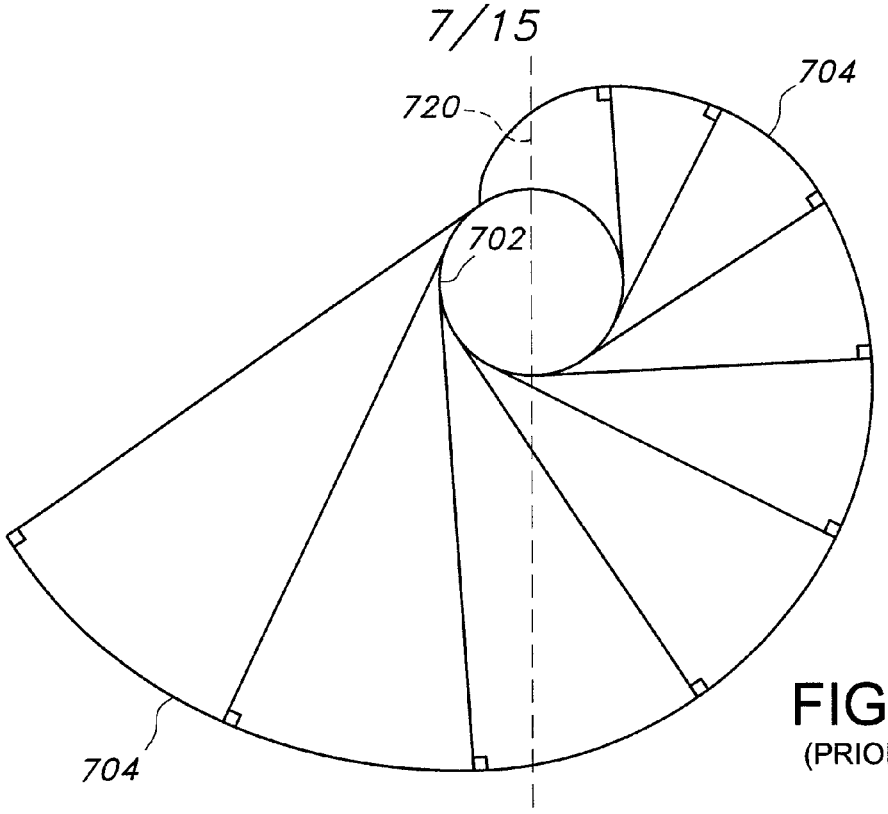
FIG. 7D (PRIOR ART)
Figure 7E:
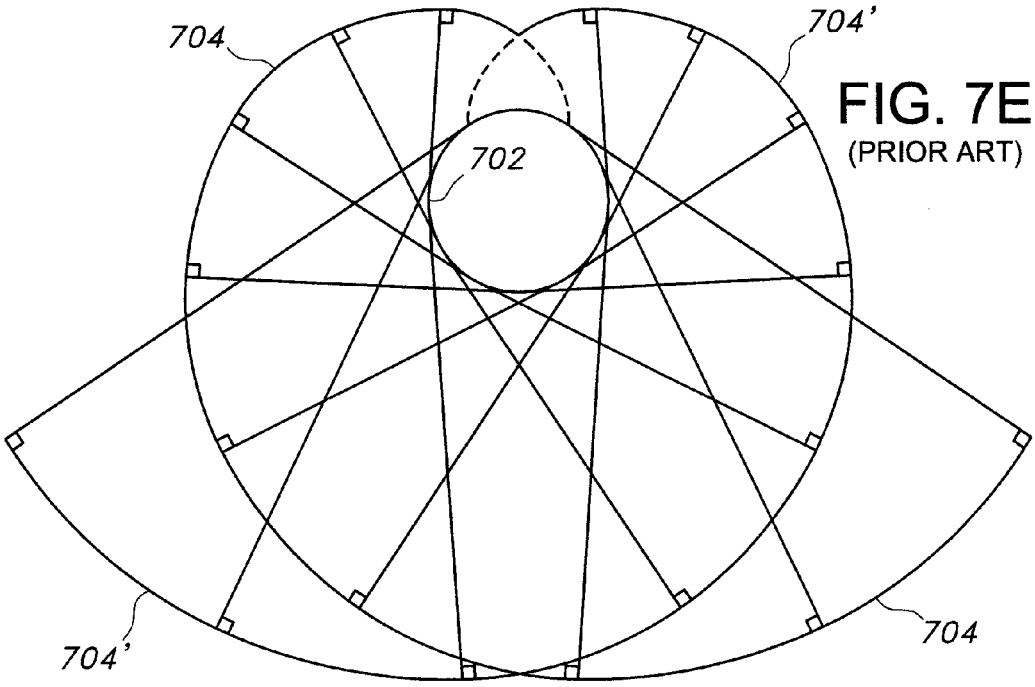
FIG. 7E (PRIOR ART)
Figure 7F:
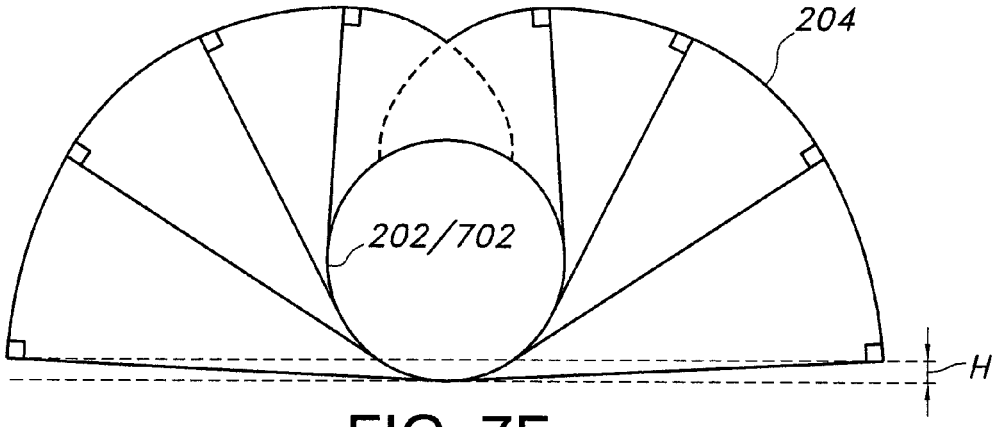
FIG. 7F (PRIOR ART)
Figure 8A:
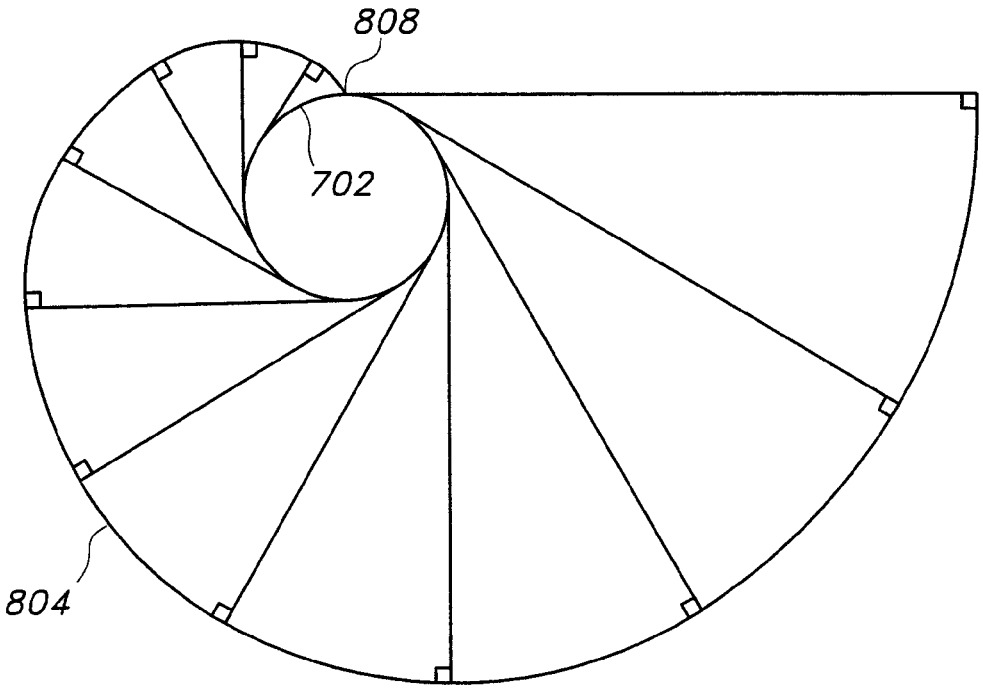
FIG. 8A (PRIOR ART)
FIGS. 8A through 8D (prior art) are additional plots of exemplary curves that describe the reflector of FIG. 3A.
Figure 8B:
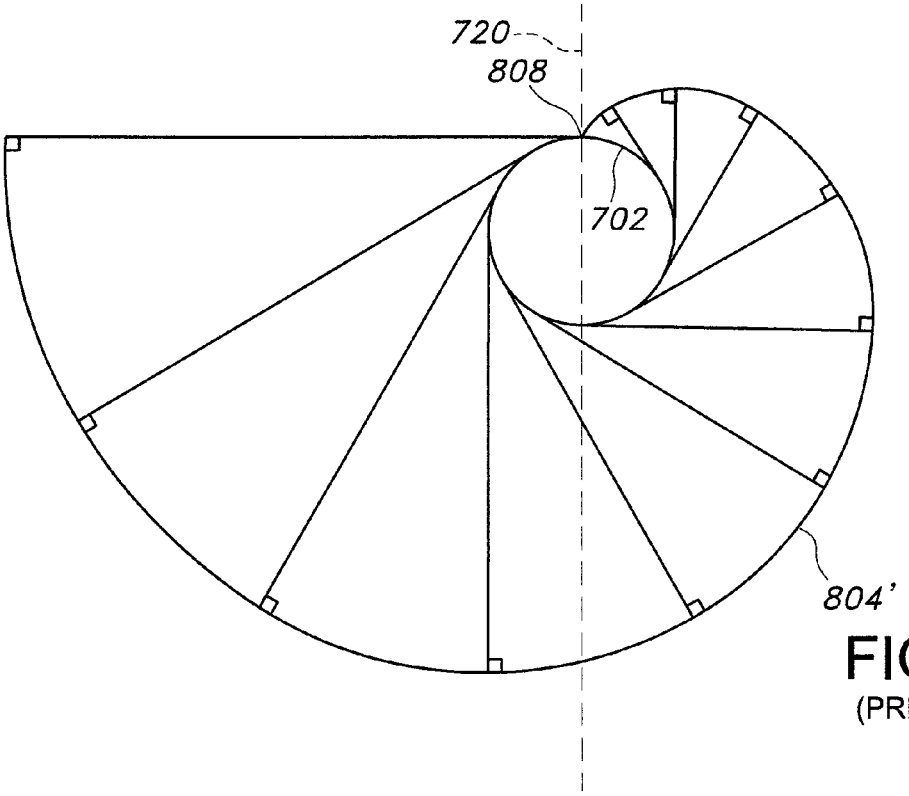
FIG. 8B (PRIOR ART)
Figure 8C:
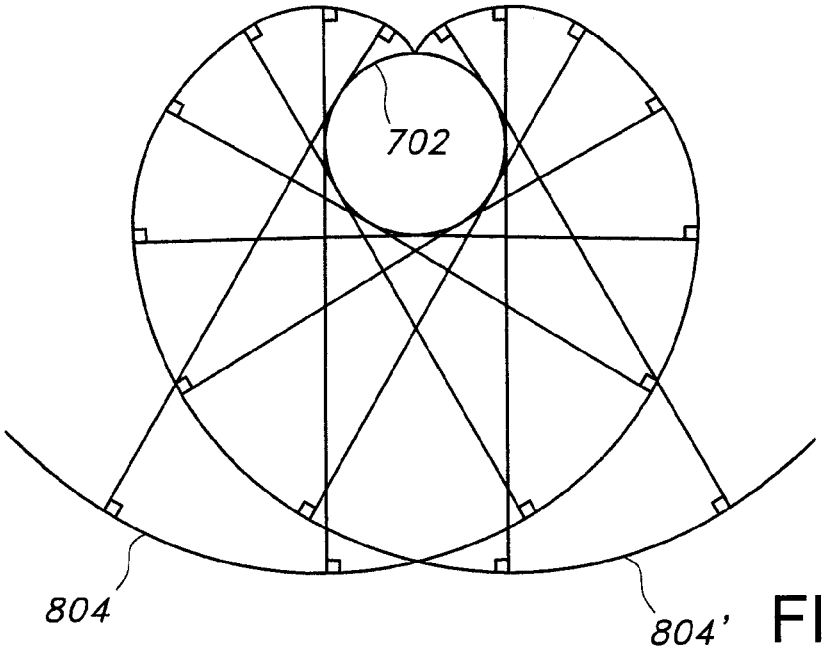
FIG. 8C (PRIOR ART)
Figure 8D:
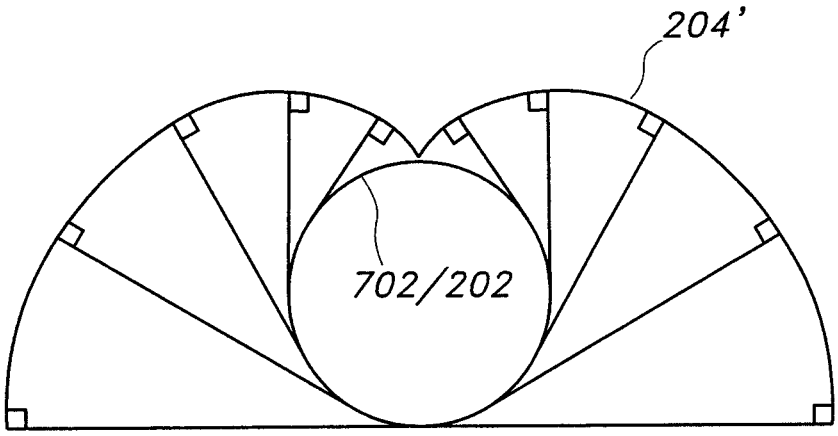
FIG. 8D (PRIOR ART)

The objective of the wing is to re-direct that turbulent radiant energy toward the first direction 33. Admittedly, the wings 30 appear to be a simple solution, but it is contrary to what has been done in prior known radiant heaters that have either a lip or no lip. Moreover, the radiant heating efficiency of the instant invention is remarkably superior to the radiant heating efficiency of the prior-known radiant heaters—as illustrated in FIGS. 1*a* and 4*a*. Set forth is a chart that confirms the superiority of the instant invention in relation to the embodiments illustrated in FIGS. 1*a* and 4*a*.

| Device | Radiant efficiency | Improvement (%) |
|---|---|---|
| FIG. 1A | 65.4 | |
| FIG. 1A with wing | 68.5 | 3.1 |
| FIG. 4a | 69 | |
| FIG. 4a with wing | 72.4 | 3.4 |

As confirmed above, the increased radiant heating efficiency is obtained through the heating wings. These results are applicable to the radiant heaters being parallel with the ground or angled in relation to the ground.

The above-identified heating wings can be applied to existing radiant heaters without wings (there are none to the applicant's knowledge) to obtain the desired increased radiant heating efficiency.

Radiant Efficiency Measurement Apparatus

The radiant efficiency measurement apparatus—that abides to a conventional industry standard described in a manual identified as CAN/ANSI/AHRI 1330-2015, *Performance Rating for Radiant Output of Gas Fire Infrared Heaters* and is a radiometer wherein, as of filing this application, the sole manufacturer of the radiometer is DVGW Forschungsstelle, am Engler-Bunte-Institut, des Karlsruher Instituts für Technologie (KIT), Prueflaboratorium Gas, Engler-Bunte-Ring 7, D-76131 Karlsruhe (Germany) (www.dvgw-ebi.de)—is positioned a predetermined distance below a radiation reference plane (a.k.a., reference plane 199) of the radiant heating device 100. The predetermined distance can be any distance below the radiation reference plane, which is preferably about 100 mm below the radiation reference plane. The radiant efficiency measurement apparatus is, for example, a radiometer that measures radiant energy transmitted from the radiant heating device 100. The radiant efficiency is determined by dividing the radiant heating device's radiant output by the radiant heating device's heat input. For example, radiant output=50,000 BTU/h absolute heat input=100,000 BTU/h gross (Europe will be 90,000 BTU/h net)

radiant output/heat input=radiant efficiency 50% (Europe will be 55.6%)

The present invention increases the radiant efficiency, as defined above, by 3-4% points. In order to achieve that 3-4% increase in radiant efficiency the heating wings 30 of the radiant heating device 100 are applied. The invention provides a cost effective and easy to apply method to increase an infrared heaters efficiency increasing comfort and fuel savings to the end user.

Figure 17:
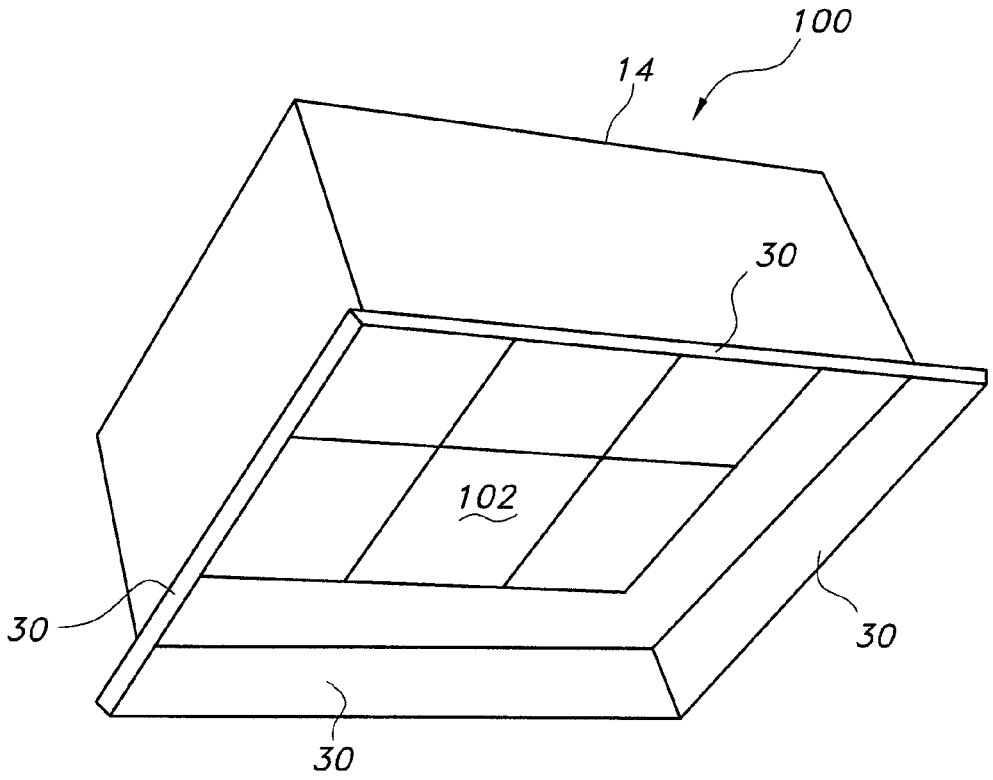
FIG. 17 illustrates the current invention applied to a high intensity/ceramic infrared heater.

The foregoing description of exemplary embodiments provides illustration and description, but is not intended to be exhaustive or to limit the embodiments described herein to the precise form disclosed. Modifications and variations are possible in light of the above teachings or may be acquired from practice of the embodiments as illustrated at FIG. 17 that illustrates the wings can be applied to different conventional heating apparatuses.

The invention claimed is:

1. A radiant heating apparatus comprising:

a transport apparatus that radiates heat energy toward a desired object;

a partial enclosure device having an opening defined at least partially by a terminal end of a reflective interior surface having a top surface positioned above the transport apparatus's top surface and two side surfaces positioned along at least a portion of the transport apparatus's side surfaces, the reflective interior surface re-directs (a) much of the heat energy that contacts the reflective interior surface in a first direction through the opening and (b) some of the heat energy that contacts the reflective interior surface rolls out from the opening in a second direction;

a heating wing having (a) a wing proximal end that connects to the partial enclosure device's exterior surface at a contact location, and (b) a wing distal end that obliquely extends outwardly in relation to the partial enclosure device and toward the first direction, and the heating wing, except at the heating wing's proximal end, and the partial enclosure device's exterior surface are spaced apart so at least a portion of the heating wing is positioned above the partial enclosure device from the contact location toward at least a portion of the terminal end, and the heating wing re-directs the rolled out heat energy in the first direction.

2. The radiant heating apparatus of claim 1 wherein the heating wing is straight.

3. The radiant heating apparatus of claim 1 wherein the heating wing is curvilinear.

4. The radiant heating apparatus of claim 1 wherein the heating wing is corrugated.

5. The radiant heating apparatus of claim 1 wherein the heating wing is straight, curvilinear, corrugated, sinusoidal, or combinations thereof.

6. The radiant heating apparatus of claim 1 wherein the wing proximal end connects to the partial enclosure device's exterior surface by rivets, adhesives, slits and slots, screws, hook and loop, welding or combinations thereof.

7. The radiant heating apparatus of claim 1 wherein the space between the heating wing, except at the wing proximal end, and the partial enclosure device's exterior surface is filled with air.

8. The radiant heating apparatus of claim 1 wherein the space between the heating wing, except at the heating wing's proximal end, and the partial enclosure device's exterior surface is filled with insulation.

9. The radiant heating apparatus of claim 1 wherein the space between the wing distal end and the partial enclosure device's terminal end is between 1 cm to 50 cm.

10. The radiant heating apparatus of claim 9 wherein the space between the wing distal end and the partial enclosure device's terminal end is between 5 cm to 40 cm.

11. The radiant heating apparatus of claim 9 wherein the space between the wing distal end and the partial enclosure device's terminal end is about 10 cm.

12. A process to alter a radiant heating apparatus to be more radiant efficient comprising:

selecting the radiant heating apparatus having a transport apparatus through which a hot fluid is transported and the transport apparatus radiates heat energy to transfer the heat energy toward a desired object; and a partial enclosure device having an opening defined at least partially by a terminal end of a reflective interior surface, the reflective interior surface re-directs (a) much of the heat energy that contacts the reflective interior surface in a first direction through the opening and (b) some of the heat energy that contacts the reflective interior surface and rolls out after the heat energy passes through the opening;

connecting a heating wing to the radiant heating apparatus wherein the heating wing has (a) a wing proximal end that connects to the partial enclosure device's exterior surface at a contact location, and (b) a wing distal end that obliquely extends outwardly in relation to the partial enclosure device and toward the first direction, and the heating wing, except at the wing proximal end, and the partial enclosure device's exterior surface are spaced apart so at least a portion of the heating wing is positioned above the partial enclosure device from the contact location toward at least a portion of the terminal end, and the heating wing re-directs the rolled out heat energy in the first direction.

13. The process of claim 12 wherein the heating wing is straight, curvilinear, corrugated, sinusoidal or combinations thereof.

14. The process of claim 12 wherein the wing proximal end connects to the partial enclosure device's exterior surface by rivets, adhesives, slits and slots, screws, hook and loop, welding or combinations thereof.

15. The process of claim 12 wherein the space between the heating wing, except at the wing proximal end, and the partial enclosure device's exterior surface is filled with air.

16. The process of claim 12 wherein the space between the heating wing, except at the wing proximal end, and the partial enclosure device's exterior surface is filled with insulation.

17. The process of claim 12 wherein the space between the wing distal end and the partial enclosure device's terminal end is between 1 cm to 50 cm.

18. The process of claim 17 wherein the space between the wing distal end and the partial enclosure device's terminal end is between 5 cm to 40 cm.

19. The process of claim 18 wherein the space between the wing distal end and the partial enclosure device's terminal end is about 10 cm.

20. A radiant heating apparatus comprising:

a transport apparatus through which a hot fluid is transported and the transport apparatus radiates heat energy to transfer the heat energy toward a desired object;

a partial enclosure device having an opening defined at least partially by a terminal end of a reflective interior surface, the reflective interior surface re-directs (a) much of the heat energy that contacts the reflective interior surface in a first direction through the opening and (b) some of the heat energy that contacts the reflective interior surface and rolls out after the heat energy passes through the opening;

a heating wing that is straight, curvilinear, corrugated, sinusoidal or combinations thereof, having (a) a wing proximal end that connects to the partial enclosure device's exterior surface by rivets, adhesives, welding or combinations thereof at a contact location, and (b) a wing distal end that obliquely extends outwardly in relation to the partial enclosure device and toward the first direction, and the heating wing, except at the wing proximal end, and the partial enclosure device's exterior surface are spaced apart a distance between 1 cm to 50 cm so at least a portion of the heating wing is positioned above the partial enclosure device from the contact location toward at least a portion of the terminal end, and the heating wing re-directs the rolled out heat energy in the first direction.

* * * * *